US006482097B1

(12) United States Patent
Fireman

(10) Patent No.: US 6,482,097 B1
(45) Date of Patent: Nov. 19, 2002

(54) AQUATIC GAME

(75) Inventor: Andrew F. Fireman, North Bethesda, MD (US)

(73) Assignee: Riva Sports, Inc., Rockville, MD (US)

( * ) Notice: Subject to any disclaimer, the term of this patent is extended or adjusted under 35 U.S.C. 154(b) by 0 days.

(21) Appl. No.: 09/938,267

(22) Filed: Aug. 23, 2001

(51) Int. Cl.[7] ..... A63G 31/00

(52) U.S. Cl. ..... 472/128; 472/129; 273/350; 273/140

(58) Field of Search ..... 472/13, 128, 129; 441/5, 136; 446/153; 273/350, 120 R, 140, 447, 457

(56) References Cited

U.S. PATENT DOCUMENTS

| | | | | | |
|---|---|---|---|---|---|
| 3,350,097 | A | * | 10/1967 | Chevrette et al. | 273/350 |
| 3,457,670 | A | * | 7/1969 | Lewis | 446/153 |
| 3,694,837 | A | * | 10/1972 | Von Norring | 114/264 |
| 3,703,011 | A | * | 11/1972 | Goggi et al. | 114/346 |
| 4,714,249 | A | * | 12/1987 | Barlow | 273/447 |
| 5,632,490 | A | * | 5/1997 | Brown | 273/138.3 |

* cited by examiner

*Primary Examiner*—Kien T. Nguyen

(57) ABSTRACT

The present invention is an aquatic game that floats on the water and releases treasure members at different time intervals. The aquatic game comprises a base member adapted to float on the water. The base member has an upper portion above disposed the water and a lower portion disposed below the water. The lower portion has first and second exit channels in communication with the water. The aquatic game further comprises an upper member rotatably engaged to the base member from a first position to a second position. The upper member further comprises a cavity portion having an opening. The aquatic game further comprises first and second treasure members disposed in the cavity portion of the upper member. Each of the first and second treasure members are design with sufficient weight and buoyancy to sink in the water. Upon winding and release, rotation of the upper member to the first position causes the opening of the cavity portion to be in communication with the first exit opening of the base member, whereby the first treasure member is released into the water. A second or continued rotation of the upper member to the second position causes the opening of the cavity portion to be in communication with the second exit opening of the base member, whereby the second treasure member is released into the water.

2 Claims, 1 Drawing Sheet

AQUATIC GAME

FIELD OF THE INVENTION

The present invention relates to an aquatic game that may be used by one or more players in a water environment such as a swimming pool.

BACKGROUND OF THE INVENTION

Many adults and children enjoy playing a game while swimming in a water environment such as a pool. There is a continuing need to develop games for use in a pool that are simply and safe.

SUMMARY OF THE INVENTION

One object of the present invention is to provide a game for use by one or more players in a water environment, such as a swimming pool, that was fun, safe, and easily operated by a child or an adult.

The present invention is an aquatic game that floats on the water and releases treasure members at different time intervals. In a first embodiment, the aquatic game comprises a base member adapted to float on the water. The base member has an upper portion above disposed the water and a lower portion disposed below the water. The lower portion has first and second exit channels in communication with the water. The aquatic game further comprises an upper member rotatably engaged to the base member from a first position to a second position. The upper member further comprises a cavity portion having an opening. The aquatic game further comprises first and second treasure members disposed in the cavity portion of the upper member. Each of the first and second treasure members are design with sufficient weight and buoyancy to sink in the water. Upon winding and release, rotation of the upper member to the first position causes the opening of the cavity portion to be in communication with the first exit opening of the base member, whereby the first treasure member is released into the water. A second or continued rotation of the upper member to the second position causes the opening of the cavity portion to be in communication with the second exit opening of the base member, whereby the second treasure member is released into the water.

BRIEF DESCRIPTION OF THE DRAWINGS

The following detailed description of the invention will be more fully understood with reference to the accompanying drawings in which.

DETAILED DESCRIPTION OF THE PREFERRED EMBODIMENTS

Figure 1:
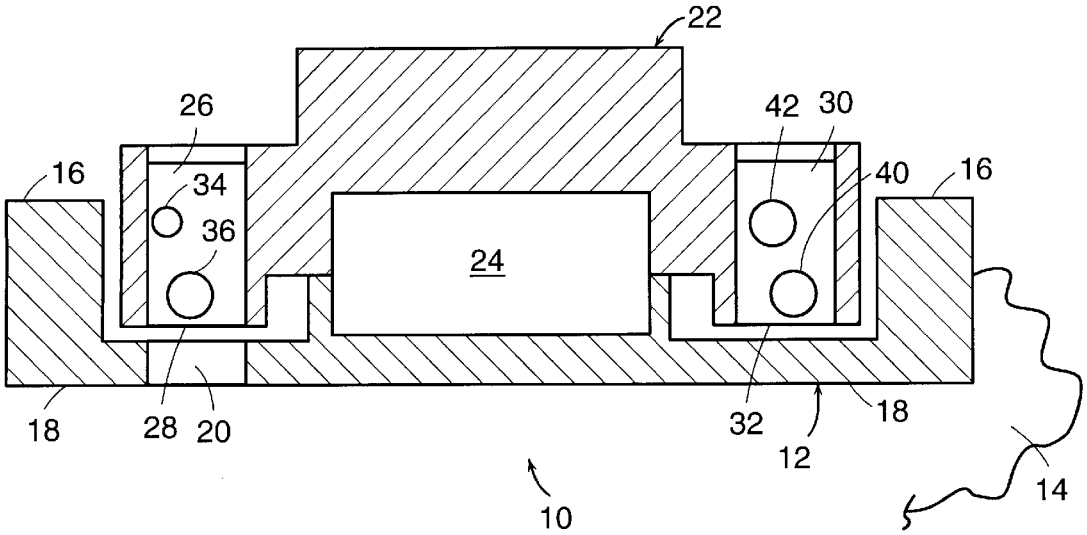
FIG. 1 is a cross-section view of the aquatic game of the present invention.
Figure 2:
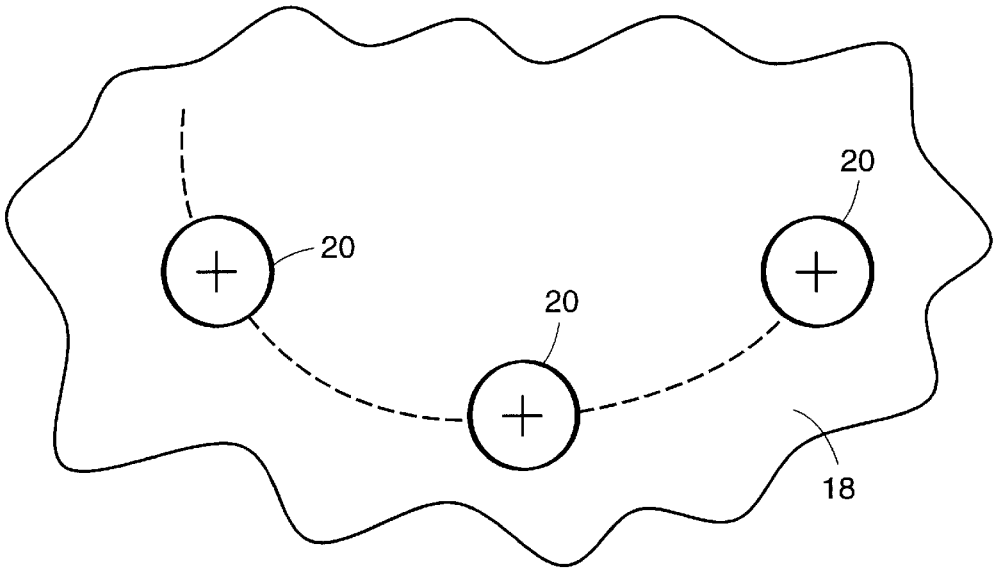
FIG. 2 is bottom plan view of the aquatic game.

Referring to FIGS. 1 and 2, the aquatic game 10 comprises a base member 12 adapted to float on the water 14. The base member 12 has an upper portion 16 disposed above the water 14 and a lower portion 18 disposed below the water 14. The lower portion 16 has a plurality of spaced exit channels 20 in communication with the water 14. The aquatic game 10 further comprises an upper member 22 rotatably engaged to the base member 12 about a rotation unit 24. The rotation unit 24 is of conventional design and allows the upper member 22 to be wound upon the base member 12. Upon winding and release, the upper member 22 rotates (in a direction opposite to being wound) at a slow velocity about the base member 12 from a first position to a second position and thereafter until the upper member 22 is unwound. The upper member 22 further comprises a first cavity portion 26 having an opening 28 and a second cavity 30 having an opening 32. The aquatic game 10 further comprises first and second treasure members 34 and 36 disposed in the cavity portions 26 and 30 of the upper member 22. Each of the first and second treasure members 34 and 36 are designed with substantial weight and non-buoyancy so they will sink to the bottom of the water or pool. Upon winding and release, rotation of the upper member 22 to a first position causes the opening 28 of the cavity portion 26 to be in communication with the first exit opening 20 of the base member 12, whereby the first treasure member 34 is released into the water. A second or continued rotation of the upper member 22 to a second position causes the opening 28 of the cavity portion 26 to be in communication with the next adjacent exit opening 20 of the base member 12, whereby the second treasure member 36 is released into the water. Continued rotation causes the opening 28 to be in communication with the next exit channel 20 (not shown) and continued until the upper member. 22 is completed unwound. Use of second cavity portion 30 allow additional treasure members 40 and 42 to be released at different times.

In operation, the player may wind-up the upper member 22 and lock the same in place by for example further engagement of the upper member 22 and the base member 14. Thereafter, the player may load the cavity portions 26 with the treasure members 34 and 36 and 40 and 42, respectively. To start the game 10, the player while standing in the water may release the upper member 22 and dive under water to catch as many treasure members as possible before the upper member 22 stops rotating about the base member 12. In this regard, the rotation unit 24 is a timing unit with an initial or start time defined when the upper member 22 is fully wound and an end or expiration time defined when the upper member 22 is completely unwound. Between the start and stop times, treasure members retained in the cavity portions 26 and 30 are dropped into the water at different intervals measured as the openings 28 and 32 of cavity portions 26 and 30 come into engagement with the spaced exit channels 20. The base member 12 and the upper member 22 are preferably made from a plastic material and fabricated by injection and/or blow molding processes.

Although not shown, the game 10 may have a flag that rises from the uppermost portion of the upper member 22 upon expiration of the time. The game 10 may comprise a trigger unit that launches rather than drop he treasure members from the bottom of the base member 12. The game 10 may also have a voice chip that plays one or messages to the person as the game 10 is played. The game 10 may have a power source to provide power to the voice chip and/or an electric powered rotation unit and trigger unit. If electronics are used, the package design should be water proof insomuch as the game 10 is played in a water environment.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. An aquatic game for use in water, the game comprises:

(a) a base member adapted to float on the water, said base member having an upper portion disposed above the water and a lower portion disposed below the water, said lower portion having first and second exit channels in communication with the water;

(b) an upper member rotatably engaged to said base member from a first position to a second position, said upper member further comprises a cavity portion having an opening;

(c) first and second treasure members disposed in said cavity portion of said upper member, said first and second treasure members having sufficient weight and buoyance to sink in the water;

(d) first rotation of said upper member to said first position causes said opening of said cavity portion to be in communication with said first exit opening of said base member to allow said first treasure member to be released into the water; and (e) second rotation of said upper member to said second position causes said opening of said cavity portion to be in communication with said second exit opening of said base member to allow said second treasure member to be released into the water.

2. The aquatic game of claim 1, further comprising a rotation unit having an upper portion rotatably engaged to a lower portion, rotation of the upper member causes the upper portion to be rotated and said rotation unit to be wound, release of said upper member causes said upper member to rotate about said lower member from the first position to the second position.

* * * * *